United States Patent [19]

Baumgartner et al.

[11] 4,422,626

[45] Dec. 27, 1983

[54] APPARATUS FOR REPAIRING A REFRACTORY FURNACE LINING

[75] Inventors: Friedrich Baumgartner; Alfred Romar; Albert Rigles, all of Veitsch, Austria

[73] Assignee: Veitscher Magnesitwerke-Actien-Gesellschaft, Vienna, Austria

[21] Appl. No.: 437,910

[22] Filed: Nov. 1, 1982

[30] Foreign Application Priority Data

Nov. 13, 1981 [AT] Austria ..... 4918/81

[51] Int. Cl.[3] ..... F27D 1/16

[52] U.S. Cl. ..... 266/281; 264/30

[58] Field of Search ..... 266/281, 287, 44; 264/30, 270; 239/223, 224, 676; 366/182, 154, 167, 132; 222/310, 317

[56] References Cited

U.S. PATENT DOCUMENTS

| | | | |
|---|---|---|---|
| 4,033,514 | 7/1977 | Weiss et al. | 266/281 |
| 4,108,384 | 8/1978 | Egli | 266/281 |
| 4,114,195 | 9/1978 | Dirksing et al. | 366/167 |
| 4,199,108 | 4/1980 | Baumgartner et al. | 266/281 |
| 4,238,076 | 12/1980 | Weiss et al. | 264/30 |

FOREIGN PATENT DOCUMENTS

| | | |
|---|---|---|
| 352767 | 2/1978 | Austria . |
| 354492 | 1/1980 | Austria . |
| 974676 | 11/1964 | United Kingdom . |
| 1372157 | 10/1974 | United Kingdom . |
| 2063717 | 6/1981 | United Kingdom . |

*Primary Examiner*—L. Dewayne Rutledge
*Assistant Examiner*—S. Kastler
*Attorney, Agent, or Firm*—Kurt Kelman

[57] ABSTRACT

An apparatus for building up and repairing a refractory lining of an industrial furnace by means of a rotary disc centrifugally throwing particulate refractory material against a portion of the lining to be repaired comprises a horizontal row of hollow bolts with bores to spray water into an inlet conduit of annular cross section whereby the material passing through the conduit to the disc will be uniformly wetted. Wiper elements in the conduit prevent jamming of the material therein and finely divided compressed gas is blown in the inlet funnel that supplies the material to the conduit.

10 Claims, 3 Drawing Figures

APPARATUS FOR REPAIRING A REFRACTORY FURNACE LINING

Figure 1:
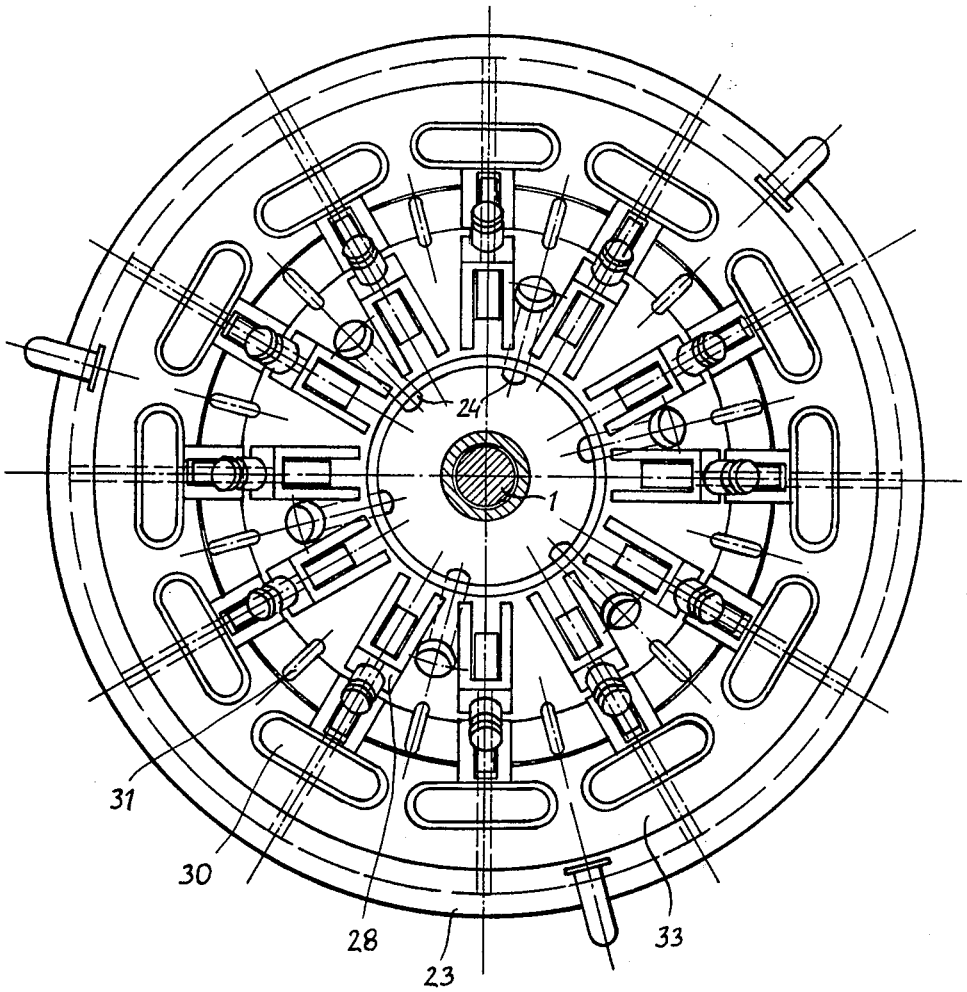

The present invention relates to improvements in an apparatus for building up and repairing a portion of a refractory lining of an industrial furnace or hot-running vessel, which comprises a vertically extending rotary shaft, a horizontally extending centrifuging disc keyed to the shaft for rotation therewith, the disc being capable of being lowered into the furnace or vessel, an inlet funnel surrounding the shaft above the disc for supplying a particulate refractory material thereto whereby the disc may be lowered into the furnace or vessel and rotated for centrifugally throwing the supplied refractory material against the portion of the refractory lining to be built up and repaired, a conical element keyed to the shaft for rotation therewith and defining a conically outwardly tapering inlet conduit of annular cross section having an upper end in communication with the inlet funnel and a lower end above the disk, the inlet conduit having an inner wall and an outer wall, a bell-shaped shutoff valve body surrounding the shaft and vertically adjustably mounted in the inlet funnel for regulating the communication between the inlet funnel and the upper inlet conduit end, and adjustable slide means at the lower inlet conduit end for regulating the flow of the material from the inlet conduit to the disc.

An apparatus of this type has been disclosed in U.S. Pat. No. 4,238,076. In this known apparatus, a cylindrical conduit connects the storage container for the particulate refractory material to the inlet conduit. Helical vanes are arranged in the cylindrical conduit for mixing the material with water injected into the conduit and further mixing is effected by obliquely positioned vanes in the inlet conduit. While this apparatus has been used with considerable success under most operating conditions, the conduits sometimes become clogged.

It is the primary object of this invention to prevent clogging in an apparatus of the indicated type and to assure the continuous delivery of the particulate refractory material to the centrifuging disc.

The above and other objects are accomplished according to the invention by providing the apparatus with means for spraying water into the inlet conduit, the water spraying means including a horizontal row of bolts extending from the outer wall into the inlet conduit and distributed over the periphery thereof, at least one of the bolts being hollow and having bores, and a source of water connected to each hollow bolt for spraying the water through the bores. Furthermore, wiper elements project into the inlet conduit from the inner and outer walls, and means is provided for delivering a gas under pressure into the inlet funnel in the range of the shutoff valve body, the means including a circular chamber, a porous cover over the circular chamber and a source of gas under pressure connected to the circular chamber whereby the gas under pressure enters the inlet funnel in finely distributed form.

This improved arrangement produces a very intimate mixing of the particulate refractory material with the water. This intimate mixing is based on the loosening of the material in the inlet funnel by the gas delivered thereinto under pressure in finely distributed form, for example compressed air, which causes the finely divided or powdery material to flow into the inlet conduit like a liquid. In this manner, the amount of dry material in the mixture conveyed to the centrifuging disc can be simply and reproducibly controlled merely by vertically adjusting the bell-shaped shutoff valve body. This control enables the flow of the dry material to be adapted accurately to the discharge of wetted material from the centrifuging disc, which is controlled by the adjustable slide means. This prevents undue wear of the centrifuging disc as well as clogging. Furthermore, the particulate material fluidized by the compressed air blown into the inlet funnel will flow evenly into the inlet conduit where it will be very uniformly wetted by the water. The friction coefficient of the wetted mass reaching the centrifuging disc after being wiped off the walls of the inlet conduit will accordingly be uniform, assuring a uniform centrifugal discharge of the wetted mass from the rotating disc and preventing clogging. The uniform wetting of the dry particulate material and the uniform centrifugal discharge of the wetted material also assures a considerably improved adherence of the material on the refractory lining to be built up and repaired.

Figure 2:
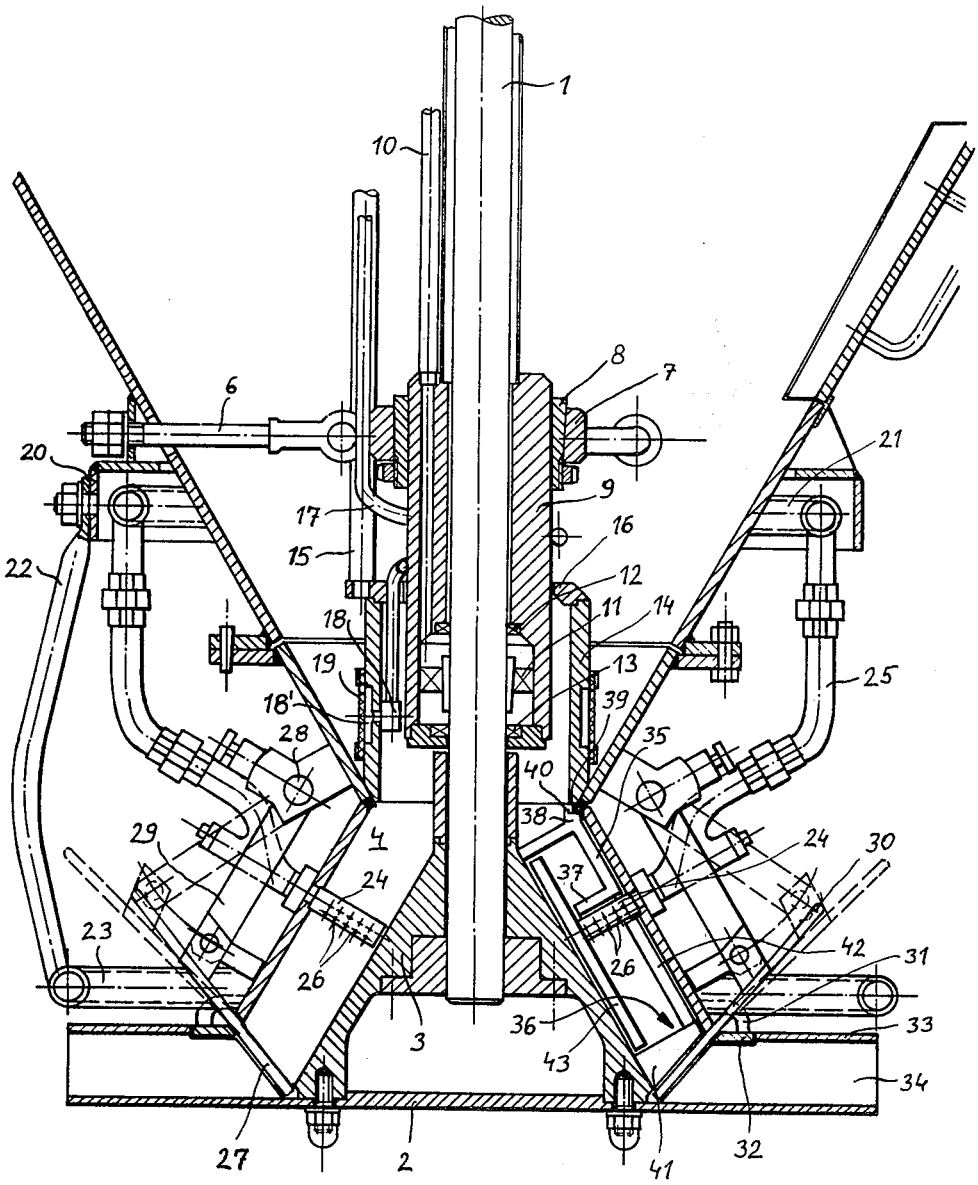
Figure 3:
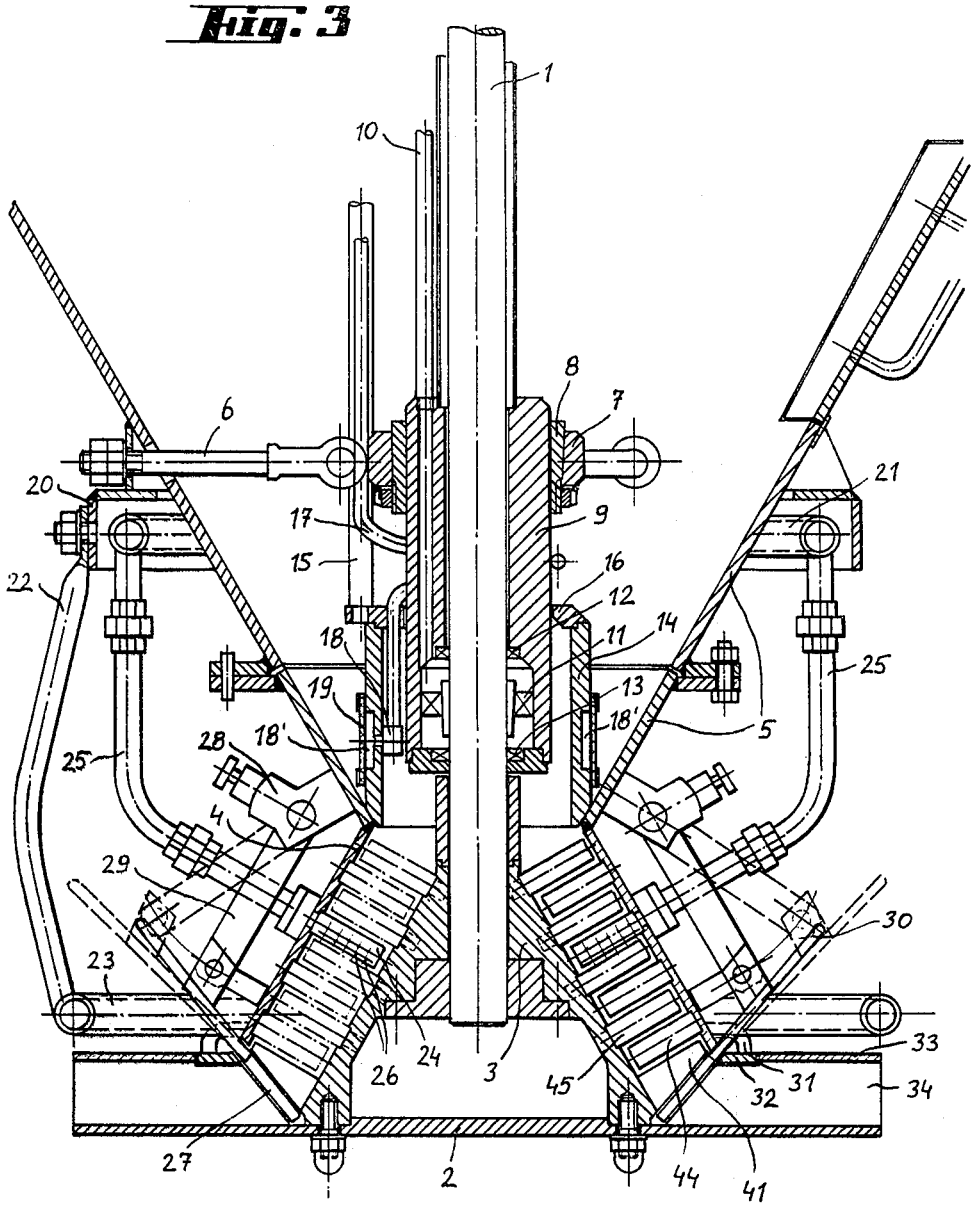

The above and other objects, advantages and features of the present invention will become more apparent from the following detailed description of certain now preferred embodiments thereof, taken in conjunction with the accompanying drawing wherein FIG. 1 is a top view of an apparatus, with the inlet funnel removed;

FIG. 2 is a vertical section of the apparatus, showing one embodiment of this invention: and FIG. 3 is a like view showing another embodiment differing from the embodiment of FIG. 2 only with respect to the wiper elements.

Referring now to the drawing, wherein like reference numerals refer to like parts functioning in a like manner in all figures, the apparatus for building up and repairing a portion of a refractory lining of an industrial furnace or hot-running vessel is shown to comprise vertically extending rotary shaft 1 and horizontally extending centrifuging disc 2 keyed to shaft 1 for rotation therewith. The entire apparatus with the disc is capable of being lowered into the furnace or vessel (not shown) and is suspended therein during operation coaxially with the furnace or vessel. Inlet funnel 5 surrounds shaft 1 above disc 2 for supplying a particulate refactory material thereto whereby the disc may be lowered into the furnace or vessel and rotated for centrifugally throwing the supplied refractory material against the portion of the refractory lining to be built up or repaired. Conical element 3 is keyed to shaft 1 for rotation therewith and defines conically outwardly tapering inlet conduit 4 of annular cross section. The inlet conduit has an upper end in communication with inlet funnel 5 and a lower end above disc 2, inlet conduit 4 having an inner wall constituted by the mantle of conical element 3 and an outer wall.

Bell-shaped shutoff valve body 14 surrounds shaft 1 and is vertically adjustably mounted in inlet funnel 5 for regulating the communication between the inlet funnel and the upper inlet conduit end. The shutoff valve body is mounted for vertical adjustment in the following manner:

Support ring 7 is held in position in inlet funnel 5 by three radial arms 6 and bearing housing 9 is supported in the ring by clamping ring 8 whose conically tapering wedging periphery engages support ring 7. The bearing housing has a bore receiving lubricating oil from conduit 10 and leading to a box containing anti-friction bearing 11 engaging rotary shaft 1. The anti-friction bearing box is sealed off from the interior of inlet funnel 5 by gaskets 12, 13. The lower portion of bearing housing 9 serves as a guide for the vertical adjustment of bell-shaped shutoff valve body 14, for which purpose three vertical rods 15 are attached to guide ring 16 at the upper end of the valve body, which slidably engages the bearing housing.

The invention provides means for delivering a gas under pressure, such as compressed air, into inlet funnel 5 in the range of shutoff valve body 14. In the illustrated embodiments, this means includes circular chamber 18' defined in a surface of the bell-shaped shutoff valve body facing inlet funnel 5, porous cover 19 mounted over the circular chamber and a source of gas under pressure connected to the circular chamber whereby the gas under pressure enters the inlet funnel in finely distributed form. The compressed air source comprises conduit 17, which is a hose loosely wound about bearing housing 9, one of rods 15 being hollow and a portion of conduit 17 being mounted in the hollow rod and connecting a supply of compressed air to circular chamber 18'. This arrangement of annular compressed air distributing chamber 18' causes the finely distributed compressed air to be upwardly deflected by the wall of inlet funnel 5 and thus producing turbulence in the funnel and corresponding fluidizing of the particulate material therein. As shown, the inner end of conduit 17 has nipple 18 communicating with annular chamber 18'.

The invention furthermore provides means for spraying water into inlet conduit 4, which is shown to include a horizontal row of bolts 24 extending from the outer wall into inlet conduit 4 and distributed over the periphery thereof. At least one of these bolts is hollow and has bores 26. A source of water is connected to each hollow bolt for spraying the water through the bores. As shown in the drawing, protective ring 20 is affixed to inlet funnel 5 and covers annular main 21 connected to a source of water. Protective braces 22 are affixed to protective ring 20 and carry another protective ring 23. Pipes 25 connect water main 21 to respective hollow bolts 24. As shown, bores 26 are preferably arranged solely in a half of bolt 24 facing away from bell-shaped shutoff valve body 14 to inject the water downwardly into the fluidized material flowing through inlet conduit 4.

Adjustable slide means at the lower inlet conduit end regulate the flow of the material from inlet conduit 4 to disc 2, the illustrated slide means comprising slides 27 extending obliquely to a transverse plane perpendicular to the inlet conduit. The slides have trapezoidal end portions with shorter end edges arcuately conforming to conical element 3 and the slide end portions being adjacent each other in their slid-in positions. Pivotal levers 29 link the outer ends of the slides to bracket 28 on the inlet funnel for guiding the slides and each slide has a handle 30. This avoids the conventional arrangement of loose slides with openings of different sizes, which may be inserted according to requirements but are often lost, being additionally subject to the danger of being coated with the wetted material. The oblique positioning of the slides has considerable advantages in permitting the wetted material to be uniformly transferred from conduit 4 to disc 2 and improves the control of the material flow. Slides 27 are guided between the lower end of inlet conduit 4 and guide ring 32 surrounding the lower inlet conduit end, the guide ring being affixed to the inlet conduit by bracket 31. Since there is no web between two adjacent end portions of slides 27 in their open position, no material can be clogged between the slides, thus eliminating another source of trouble.

Guide ring 32 is not absolutely necessary for guidance of slides 27. In the absence thereof, two radially spaced levers 29 may be linked to each slide for guiding the same.

Cover 33 is mounted over centrifuging disc 2 and is connected thereto by webs 34.

Two embodiments of wiper elements projecting into inlet conduit 4 from the inner and outer walls are disclosed herein.

In the embodiment of FIG. 2, the wiper elements consist of strip 43 affixed to the free end of bolt 24 and extending substantially parallel to the conical element wall at a slight distance therefrom, and scrapers 35 and 36 distributed substantially uniformly about the periphery of conical element 3. The scrapers have a first leg extending parallel to strip 43 and at a slight distance from the outer inlet conduit wall and a second leg projecting into the inlet conduit at a respective one of the conduit ends and wiping over strip 43. This arrangement prevents any coating of the inlet conduit walls with the wetted mass flowing through the conduit in a manner not achievable with the helical vanes of the prior art.

In the illustrated embodiment, scrapers 35 at the upper inlet conduit end are substantially U-shaped. The U-shaped scrapers have shorter leg 37 close to bolt 24 and extending parallel thereto. Scrapers 36 at the lower inlet conduit end are substantially L-shaped and first leg 42 of the L-shaped scrapers has a free end close to the bolt. The scrapers are connected to conical element 3 in the range of the upper and lower conduit ends and are distributed at regular intervals about the periphery of the conical element to prevent imbalance during rotation. During rotation of conical element 3, shorter leg 37 of scraper 35 moves in a circular path slightly spaced from bolt 24 to wipe the bolt along its upper side, clogging of the lower side being prevented by the flow of water through bores 26 at the lower side.

In the illustrated embodiment, U-shaped scrapers 35 have projections 38 with a rim 39 extending parallel to the annular end face of bell-shaped shutoff valve body 14 facing the upper inlet conduit end. The annular end face is slightly spaced from the rim in the shutoff position of the valve body. Shoulder 40 projects from rim 39 towards the bell-shaped shutoff valve body and overlaps the spacing between the rim and annular end face in the shutoff position of the valve body so that the shoulder will scrape off any coating on the inside of the valve body during rotation of shaft 1 in relation thereto.

In the embodiment of FIG. 3, the wiper elements consist of horizontal rows of bolts 44 and 45 substantially uniformly distributed over the peripheries of the inner and outer inlet conduit walls, in addition to the row of water-injecting bolts 24. The bolts of alternating ones of the rows are interdigitatingly arranged and the bolts have free ends slightly spaced from the inner and outer inlet conduit walls, respectively. This arrangement assures an intimate and uniform mixing of the particulate material with the water as it flows down through inlet conduit 4, in addition to preventing any encrustation of the conduit walls or water-injecting nozzles 24.

In the illustrated embodiment, trapezoidal scraper elements 41 are uniformly distributed about the periphery of conical element 3 adjacent slides 27. Elements 41 may form a leg of L-shaped scrapers 36 whose other leg 42 extends parallel to strip 43. Additional elements 41 may project freely from conical element 3.

What is claimed is:

1. In an apparatus for building up and repairing a portion of a refractory lining of an industrial furnace or hot-running vessel, which comprises (a) a vertically extending rotary shaft, (b) a horizontally extending centrifuging disc keyed to the shaft for rotation therewith, the disc being capable of being lowered into the furnace or vessel, (c) an inlet funnel surrounding the shaft above the disc for supplying a particulate refractory material thereto whereby the disc may be lowered into the furnace or vessel and rotated for centrifugally throwing the supplied refractory material against the portion of the refractory lining to be built up and repaired, (d) a conical element keyed to the shaft for rotation therewith and defining a conically outwardly tapering inlet conduit of annular cross section having an upper end in communication with the inlet funnel and a lower end above the disk, the inlet conduit having an inner wall and an outer wall, the combination of (e) a bell-shaped shutoff valve body surrounding the shaft and vertically adjustably mounted in the inlet funnel for regulating the communication between the inlet funnel and the upper inlet conduit end, (f) adjustable slide means at the lower inlet conduit end for regulating the flow of the material from the inlet conduit to the disc, (g) means for spraying water into the inlet conduit, the water spraying means including (1) a horizontal row of bolts extending from the outer wall into the inlet conduit and distributed over the periphery thereof, at least one of the bolts being hollow and having bores, and (2) a source of water connected to each hollow bolt for spraying the water through the bores, (h) wiper elements projecting into the inlet conduit from the inner and outer walls, and (i) means for delivering a gas under pressure into the inlet funnel in the range of the shutoff valve body, the means including (1) a circular chamber, (2) a porous cover over the circular chamber and (3) a source of gas under pressure connected to the circular chamber whereby the gas under pressure enters the inlet funnel in finely distributed form.

2. In the apparatus of claim 1, the circular chamber being defined in a surface of the bell-shaped shutoff valve body facing the inlet funnel.

3. In the apparatus of claim 2, a hollow rod attached to the bell-shaped shutoff valve body for vertical adjustment thereof and a conduit mounted within the hollow rod and connecting the gas source to the circular chamber.

4. In the apparatus of claim 1, the wiper elements consisting of a strip arranged at a free end of at least one of the bolts and extending substantially parallel to the conical element wall, and scrapers distributed substantially uniformly about the periphery of the conical element, the scrapers having a first leg extending parallel to the strip and at a slight distance from the outer inlet conduit wall and a second leg projecting into the inlet conduit at a respective one of the conduit ends and wiping over the strip.

5. In the apparatus of claim 4, the scrapers at the upper inlet conduit end being substantially U-shaped, the U-shaped scrapers having a shorter leg close to the bolt and extending parallel thereto, and the scrapers at the lower inlet conduit end being substantially L-shaped, the first leg of the L-shaped scrapers having a free end close to the bolt.

6. In the apparatus of claim 5, the bell-shaped shutoff valve body having an annular end face facing the upper inlet conduit end and the U-shaped scrapers having projections with a rim extending parallel to the annular end face, the annular end face being slightly spaced from the rim in the shutoff position of the valve body.

7. In the apparatus of claim 6, a shoulder projecting from the rim towards the bell-shaped shutoff valve body and overlapping the spacing between the rim and annular end face in the shutoff position of the valve body.

8. In the apparatus of claim 1, the wiper elements consisting of horizontal rows of bolts substantially uniformly distributed over the peripheries of the inner and outer inlet conduit walls, the bolts of alternating ones of the rows being interdigitatingly arranged and the bolts having free ends slightly spaced from the inner and outer inlet conduit walls, respectively.

9. In the apparatus of claim 1, the bores in the bolt being arranged solely in a half of the bolt facing away from the bell-shaped shutoff valve body.

10. In the apparatus of claim 1, the adjustable slide means comprising slides extending obliquely to transverse planes perpendicular to the inlet conduit, the slides having trapezoidal end portions with shorter end edges arcuately conforming to the conical element, the slide end portions being adjacent each other in their slid-in position, and pivotal levers for guiding the slides, the pivotal levers being connected to the inlet funnel.

* * * * *